US011559725B1

(12) United States Patent
Ayal

(10) Patent No.: US 11,559,725 B1
(45) Date of Patent: Jan. 24, 2023

(54) LIGHTED SPORTS BALL, KIT, AND METHOD OF USE THEREOF

(71) Applicant: Southern Telecom Inc., Brooklyn, NY (US)

(72) Inventor: Sol Ayal, Brooklyn, NY (US)

(73) Assignee: Southern Telecom Inc., Brooklyn, NY (US)

( * ) Notice: Subject to any disclaimer, the term of this patent is extended or adjusted under 35 U.S.C. 154(b) by 0 days.

(21) Appl. No.: 17/412,819

(22) Filed: Aug. 26, 2021

(51) Int. Cl.
*A63B 43/06* (2006.01)
*A63B 102/18* (2015.01)

(52) U.S. Cl.
CPC ..... *A63B 43/06* (2013.01); *A63B 2102/18* (2015.10); *A63B 2225/74* (2020.08); *A63B 2243/007* (2013.01); *A63B 2243/0025* (2013.01); *A63B 2243/0037* (2013.01); *A63B 2243/0095* (2013.01)

(58) Field of Classification Search
CPC . A63B 43/06; A63B 2102/18; A63B 2225/74; A63B 2243/0025; A63B 2243/0037; A63B 2243/007; A63B 2243/0095
See application file for complete search history.

(56) References Cited

U.S. PATENT DOCUMENTS 2,020,484 A * 11/1935 Turner ..... A63B 43/06 473/570
3,011,048 A * 11/1961 O'Brien ..... A63B 43/06 362/208
3,804,411 A * 4/1974 Hendry ..... A63B 43/06 446/439
5,186,458 A 2/1993 Redondo
5,388,825 A * 2/1995 Myers ..... A63B 43/06 473/570
5,779,575 A * 7/1998 Hsieh ..... A63B 43/06 473/570
6,135,850 A * 10/2000 Reed ..... A63H 3/006 446/485
6,142,894 A * 11/2000 Lee ..... A63B 43/06 473/570
6,155,700 A * 12/2000 Hsu ..... F21V 23/04 362/253

(Continued)

FOREIGN PATENT DOCUMENTS

CN 103157256 A 6/2013
CN 212214524 U 12/2020
WO 201382935 A1 6/2013

*Primary Examiner* — Steven B Wong
(74) *Attorney, Agent, or Firm* — Wood Herron & Evans LLP

(57) ABSTRACT

A lighted sports ball is provided. The lighted sports ball includes an interior housing through which light can pass. The interior housing features a cavity within the interior housing. The lighted sports ball further includes a circuit board mounted to the interior housing. The circuit board is connected to a battery and has a light module as well as a controller for controlling an output of the at least one light module. An exterior cover is applied over the interior housing. The exterior cover has an aperture through which light from the light module can pass. Further, a lighted sports ball kit including a lighted sports ball and a charging stand is provided. Furthermore, a method for using the lighted sports ball is provided.

19 Claims, 8 Drawing Sheets

(56) References Cited

U.S. PATENT DOCUMENTS

| | | | | |
|---|---|---|---|---|
| 6,726,580 | B2 | 4/2004 | Peterson | |
| 8,517,870 | B2 * | 8/2013 | Crowley | A63B 41/00 473/570 |
| 8,663,040 | B2 * | 3/2014 | Kortegast | A63B 43/06 473/570 |
| 8,727,919 | B1 * | 5/2014 | Gentile | A63B 43/06 473/570 |
| 9,192,821 | B2 | 11/2015 | Smith | |
| 9,457,251 | B2 | 10/2016 | Thurman | |
| 9,518,728 | B2 * | 12/2016 | Lin | F21V 33/008 |
| 9,776,048 | B2 * | 10/2017 | Lin | F21V 33/008 |
| 9,821,196 | B2 | 11/2017 | Lin | |
| 10,159,874 | B1 * | 12/2018 | Lin | A63B 37/12 |
| 10,799,769 | B2 | 10/2020 | Wolfinbarger | |
| 11,266,883 | B2 * | 3/2022 | Ianni | A63B 41/02 |
| 2001/0049311 | A1 * | 12/2001 | Lewis | A63B 43/06 473/570 |
| 2003/0224885 | A1 * | 12/2003 | Leal | A63B 43/06 473/570 |
| 2006/0146525 | A1 * | 7/2006 | Chernick | F21V 33/008 362/196 |
| 2008/0132363 | A1 | 6/2008 | Harada | |
| 2010/0035710 | A1 | 2/2010 | Smith | |
| 2012/0040785 | A1 * | 2/2012 | De Sort | A63B 43/06 473/570 |
| 2012/0244969 | A1 * | 9/2012 | Binder | A63B 43/06 473/570 |
| 2014/0277636 | A1 | 9/2014 | Thurman | |
| 2014/0309059 | A1 | 10/2014 | Minch | |
| 2015/0159846 | A1 * | 6/2015 | Hollinger | F21V 33/008 362/183 |
| 2016/0001137 | A1 | 1/2016 | Phillips | |
| 2016/0271458 | A1 | 9/2016 | Lin | |
| 2017/0065856 | A1 * | 3/2017 | Lin | A63B 69/0002 |
| 2018/0043218 | A1 * | 2/2018 | Hu | A63B 41/00 |
| 2020/0139203 | A1 * | 5/2020 | Lin | A63B 43/06 |
| 2021/0023421 | A1 * | 1/2021 | Wolfinbarger | A63B 43/06 |
| 2021/0197032 | A1 * | 7/2021 | Lin | A63B 37/12 |

* cited by examiner

LIGHTED SPORTS BALL, KIT, AND METHOD OF USE THEREOF

TECHNICAL FIELD

The present invention relates generally to sporting goods and, in particular, to a lighted sports ball. The invention also relates to a lighted sports ball kit including the lighted sports ball and a method of using the lighted sports ball.

BACKGROUND

Sports balls are used in a variety of individual recreational and team athletic activities including sports such as baseball, basketball, football, and the like. In certain circumstances, it can be desirable to enhance the visibility of a sports ball. For example, a user may desire to use a sports ball in low-light conditions or in a darkened environment where it can be difficult to keep track of a sports ball. Further, one may desire to make the sports ball more readily distinguishable against a background for players participating in a sporting event and/or spectators watching a sporting event.

Previous attempts have been made to enhance the visibility of a sports ball. For example, U.S. Pat. No. 9,821,196 discloses a luminous ball that is similar in appearance to a baseball or softball. However, said luminous ball exhibits various shortcomings. Particularly, the construction of the luminous ball requires a user to remove the light-emitting device from the ball and place a battery therein or remove a battery therefrom in order to turn the luminous ball on or off, respectively. Further, when turned on, the color of the light emitted by the luminous ball cannot be changed by the user at the user's discretion.

As can be readily discerned from the above description, previous attempts to enhance the visibility of a sports ball leave much to be desired. Accordingly, there is a need for an improved lighted sports ball.

SUMMARY

To address these and other deficiencies, a lighted sports ball is disclosed. In one embodiment, the lighted sports ball includes an interior housing through which light can pass. The interior housing has an outer surface and an inner surface. The inner surface defines the bounds of a cavity within the interior housing. The lighted sports ball further includes a circuit board mounted to the inner surface of the interior housing and connected to a battery. The circuit board has at least one light module and a controller. The controller controls an output of the at least one light module. Additionally, an exterior cover is applied over the outer surface of the interior housing. The exterior cover has at least one aperture through which a light from the at least one light module can pass.

In a further embodiment, the interior housing further includes a first half portion and a second half portion. The first half portion and the second half portion combine at their respective peripheries to form the interior housing. Furthermore, the circuit board is mounted in a circuit board receiving area on the first half portion and the battery is mounted in a battery receiving area on the second half portion. Alternatively, the battery may not be located on the second half portion and, further, the battery receiving area may include an extended battery housing extending from the interior housing to cover a substantial portion of the battery. A wire connects the circuit board and the battery.

In yet a further embodiment, the controller is a push button that extends from the circuit board and through the interior housing such that the push button can be actuated from an exterior of the lighted sports ball. Additionally, the end of the push button that extends through the interior housing is covered by a protective cap. The end of the push button abuts the protective cap when the protective cap is depressed.

In still a further embodiment, actuating the push button causes the light module to emit the light. Further actuating the push button changes the color of the light emitted by the light module. Optionally. the controller can be addressed wirelessly to cause the light module to emit the light and to change the color of the emitted light.

In a further embodiment, the battery is rechargeable and, optionally, is capable of being recharged wirelessly. To charge the battery, the circuit includes a charging port. An end of the charging port is accessible from an exterior of the lighted sports ball. Moreover, a protective cap covers the end of the charging port and a portion of the protective cap is moveable to allow access to the charging port.

In yet a further embodiment, the exterior cover includes a first cover portion and a second cover portion. The first cover portion and the second cover portion are stitched together at a seam with a thread and combine to cover the interior housing.

In still a further embodiment, an outer appearance of the lighted sports ball may be that of a baseball, basketball, football, volleyball, or a soccer ball.

In another embodiment, a lighted sports ball kit is disclosed. The lighted sports ball kit includes a lighted sports ball. The lighted sports ball includes an interior housing through which light can pass. The interior housing has an outer surface and an inner surface. The inner surface defines the bounds of a cavity within the interior housing. Additionally, a circuit board is mounted to the inner surface of the interior housing and connected to a rechargeable battery that can be recharged wirelessly. The circuit board has at least one light module and a controller for controlling an output of the light module. Further, the lighted sports ball includes an exterior cover applied over the outer surface of the interior housing. The exterior cover has at least one aperture through which a light from the at least one light module can pass. Furthermore, the lighted sports ball kit includes a charging stand configured to receive the lighted sports ball thereupon and wirelessly charge the rechargeable battery of the lighted sports ball.

In still another embodiment, a method of using a lighted sports ball is disclosed. The lighted sports ball includes an interior housing through which light can pass. The interior housing has an outer surface and an inner surface. The inner surface defines the bounds of a cavity within the interior housing. Additionally, a circuit board is mounted to the inner surface of the interior housing and connected to a rechargeable battery. The circuit board has at least one light module and a push button for controlling an output of the at least one light module. Further the lighted sports ball includes an exterior cover applied over the outer surface of the interior housing. The exterior cover has at least one aperture through which a light from the at least one light module can pass. The method of using the lighted sports ball includes actuating the push button to cause the at least one light module to emit light. The method also includes further actuating the push button to change the color of the light emitted by the at least one light module.

The steps and elements described herein can be reconfigured and combined in different combinations to achieve the desired technical effects in different styles of lighted sports balls, as may be needed in the art. These and other objects and advantages of the present invention shall be made apparent from the accompanying drawings and the description thereof.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

The exemplary embodiments described herein are provided for illustrative purposes and are not limiting. Other embodiments are possible, and modifications may be made to the exemplary embodiments within the scope of the present disclosure. Therefore, the Detailed Description is not meant to limit the scope of the present disclosure.

With reference to FIGS. 1-9, embodiments of a lighted sports ball 10 are shown in detail. Advantageously, the lighted sports ball 10 described herein improves upon previous attempts to enhance the visibility of a sports ball. Whereas previous sports balls have suffered from issues of user friendliness and lack of customization features, the disclosed lighted sports ball 10 addresses and improves upon at least some of the previously described enhanced visibility sports ball shortcomings. Other advantages and technical effects of the embodiments of this invention will become evident to one skilled in the art from the following description.

Figure 1:
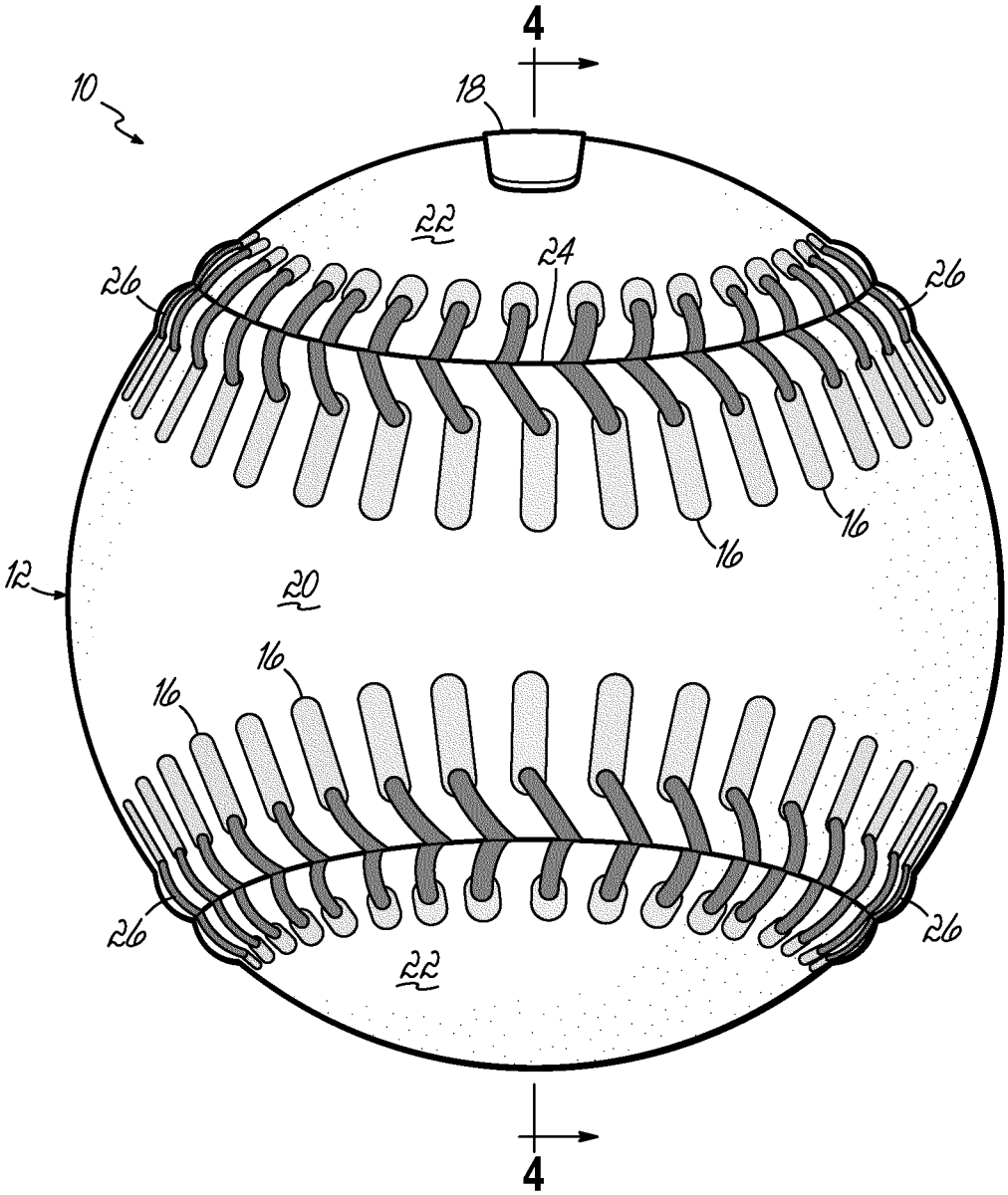
FIG. 1 is a front view of an embodiment of a lighted sports ball according to the present disclosure.

Beginning with reference to FIG. 1, an embodiment of the lighted sports ball 10 is shown. The lighted sports ball 10 has an exterior cover 12. The exterior cover 12 may be made of real or synthetic leather, plastic, or another suitable material. The exterior cover 12 is applied over an interior housing 14, described in greater detail with respect to FIG. 4A. The exterior cover 12 features at least one aperture 16 in the exterior cover 12. In the depicted embodiment, the exterior cover 12 includes a number of differently sized and shaped apertures 16. It is to be understood that the number, size, and shape of the apertures 16 will depend on the particular sports ball embodiment as well as the specific use case. The apertures 16 allow for light to pass through from the interior of the lighted sports ball 10 to the exterior of the lighted sports ball 10—thereby enhancing the visibility of the lighted sports ball 10, especially in low-light conditions. Further, the exterior cover 12 includes a protective cap 18, described in further detail with respect to FIGS. 2-4A.

The embodiment of the lighted sports ball 10 pictured in FIG. 1 has the appearance of a baseball or softball. To that end, the exterior cover 12 is divided into a first cover portion 20 and a second cover portion 22, both substantially dumbbell shaped. The second cover portion 22 features the protective cap 18. The first and second cover portions 20, 22 are joined at a seam 24 by thread 26. The thread 26 passes through apertures 16 on both the first and second cover portions 20, 22 to snugly join the first and second cover portions 20, 22 together. The size, shape, and weight of the lighted sports ball 10 is to be roughly consistent with that of standard or traditional sports balls. For example, the weight of the baseball embodiment of the lighted sports ball 10 pictured in FIG. 1 may be between 141.7 g and 148.8 g and the diameter may be approximately 7.3 cm—roughly consistent with the standard weight and dimension of a major league (e.g., MLB) baseball. Though the embodiment illustrated in FIG. 1 has the appearance of a baseball or softball, it is to be understood that other embodiments of the lighted sports ball 10 may take on other outward appearances without departing from the scope of the general inventive concept disclosed herein (for example, a basketball, shown in FIG. 6, or a football, shown in FIG. 7).

Figure 2:
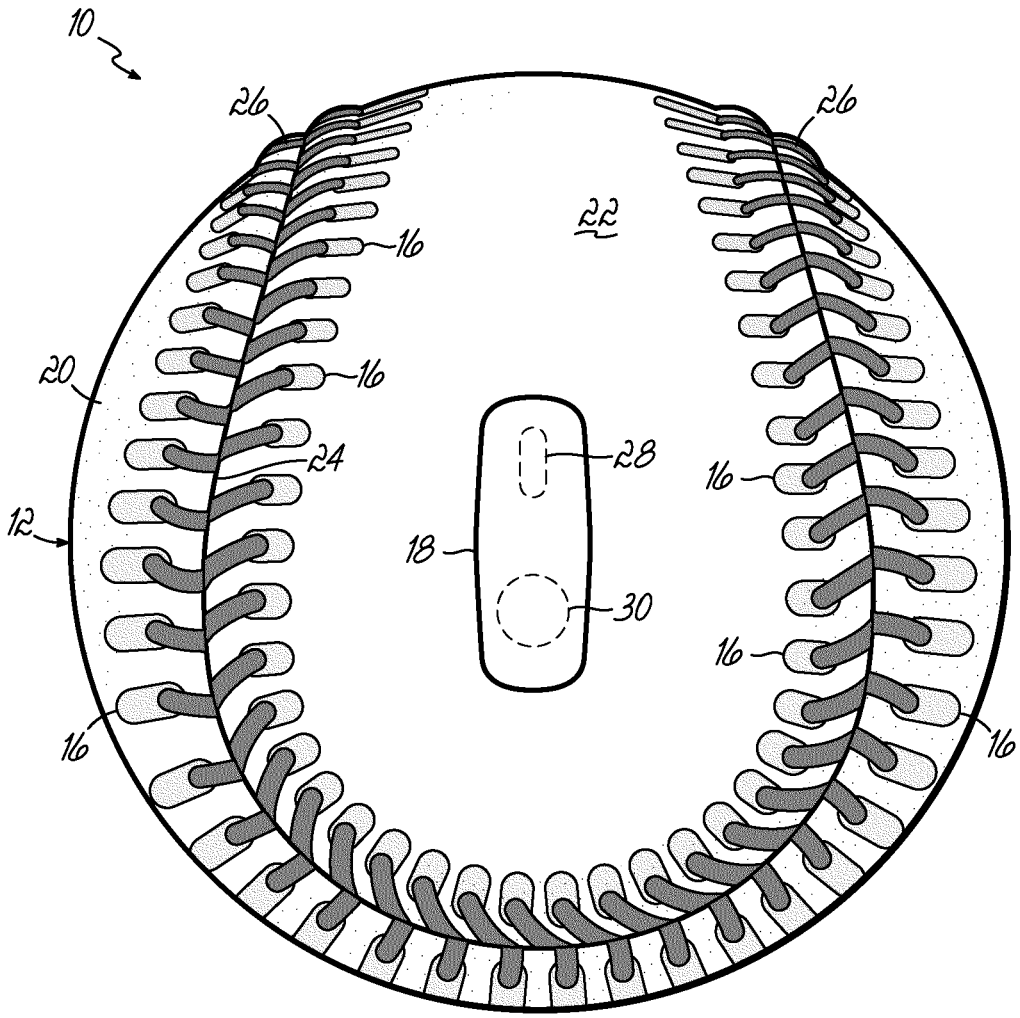
FIG. 2 is a top view of the lighted sports ball of FIG. 1.
Figure 3:
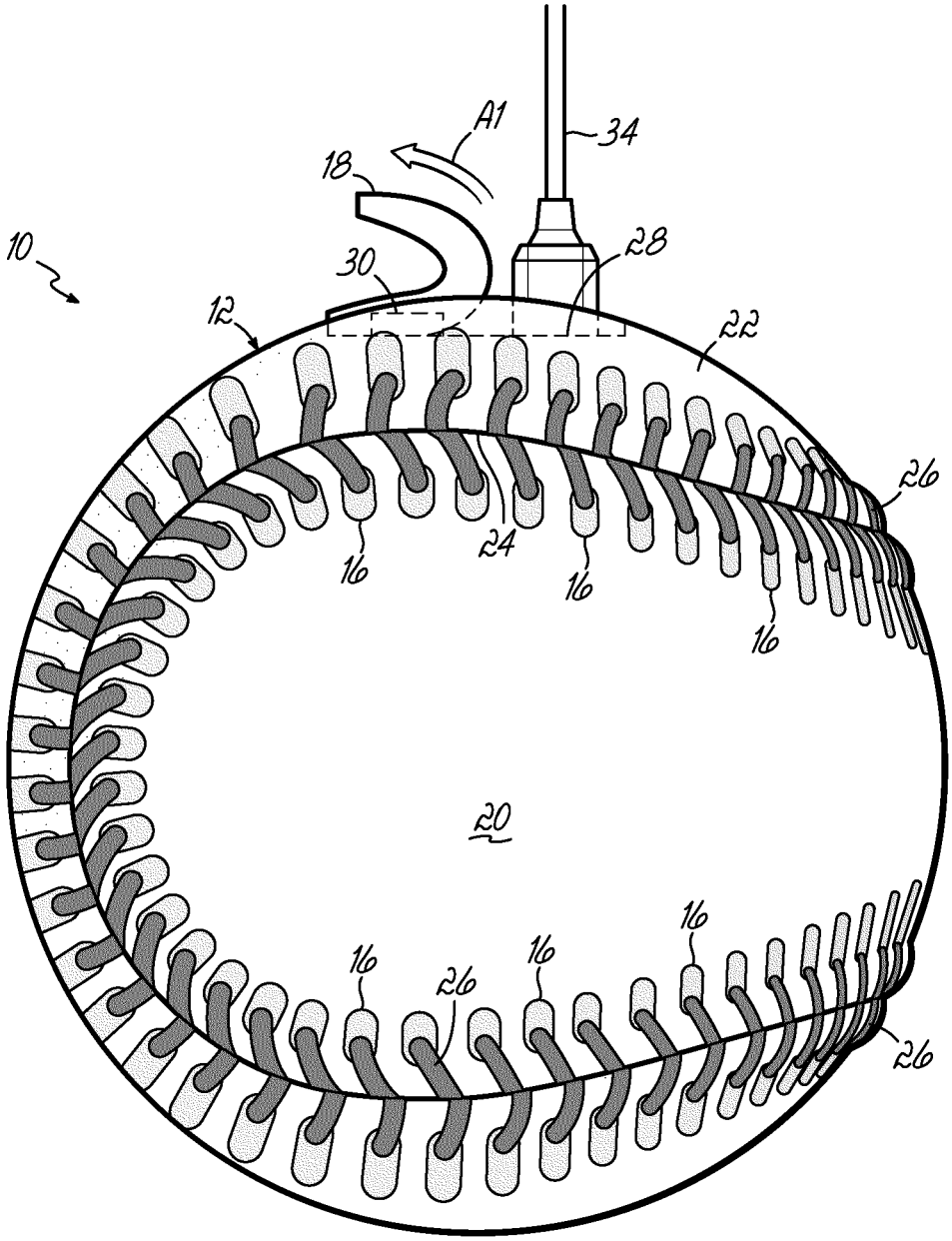
FIG. 3 is a right-side view of the lighted sports ball of FIG. 1.

Referring now to FIGS. 2 and 3, the protective cap 18 and its operation are shown in greater detail. FIG. 2 shows the charging port 28 and controller 30 (a push button in this embodiment, as described in greater detail with reference to FIG. 4A) for the lighted sports ball 10 in phantom located beneath the protective cap 18. The protective cap 18 covers the end 32 of the charging port 28 that extends from the interior of the lighted sports ball 10. Further, the protective cap 18 acts as a protective interface for the controller 30 (e.g., push button)—shielding the controller 30 from exposure to the environment, but allowing a user to interact with the controller 30 by pressing down upon the portion of the protective cap 18 that abuts or nearly abuts the controller 30. The protective cap 18 also serves to improve the aesthetic appearance of the lighted sports ball 10. Other known enhanced visibility sports balls feature large, unsightly lids or tops that allow a user to access the internals of the sports ball to, for example, turn the sports ball on or replace a battery within the sports ball. Such unsightly portions detract from the aesthetic appearance of the sports ball and make it apparent to an unwitting observer that the sports ball is somehow different (e.g., lighted versus non-lighted or traditional). The minimalist protective cap 18 of the lighted sports ball 10 provides for a more pleasant appearance as compared to other known enhanced visibility sports balls.

Further, as is shown in FIG. 3 by arrow A1, a portion of the protective cap 18 is moveable such that a user can peel back an end of the protective cap 18 to reveal the charging port 28 to allow for a charging cable 34 to be inserted therein. Additionally, the protective cap 18 allows a user to interact with the controller 30 through the protective cap 18 without having to remove or peel back the end of the protective cap 18 that covers the controller 30. Thus, the protective cap 18 can be made from a flexible, yet durable material such as rubber or the like. It is to be understood that other suitable materials could be used.

Figure 4A:
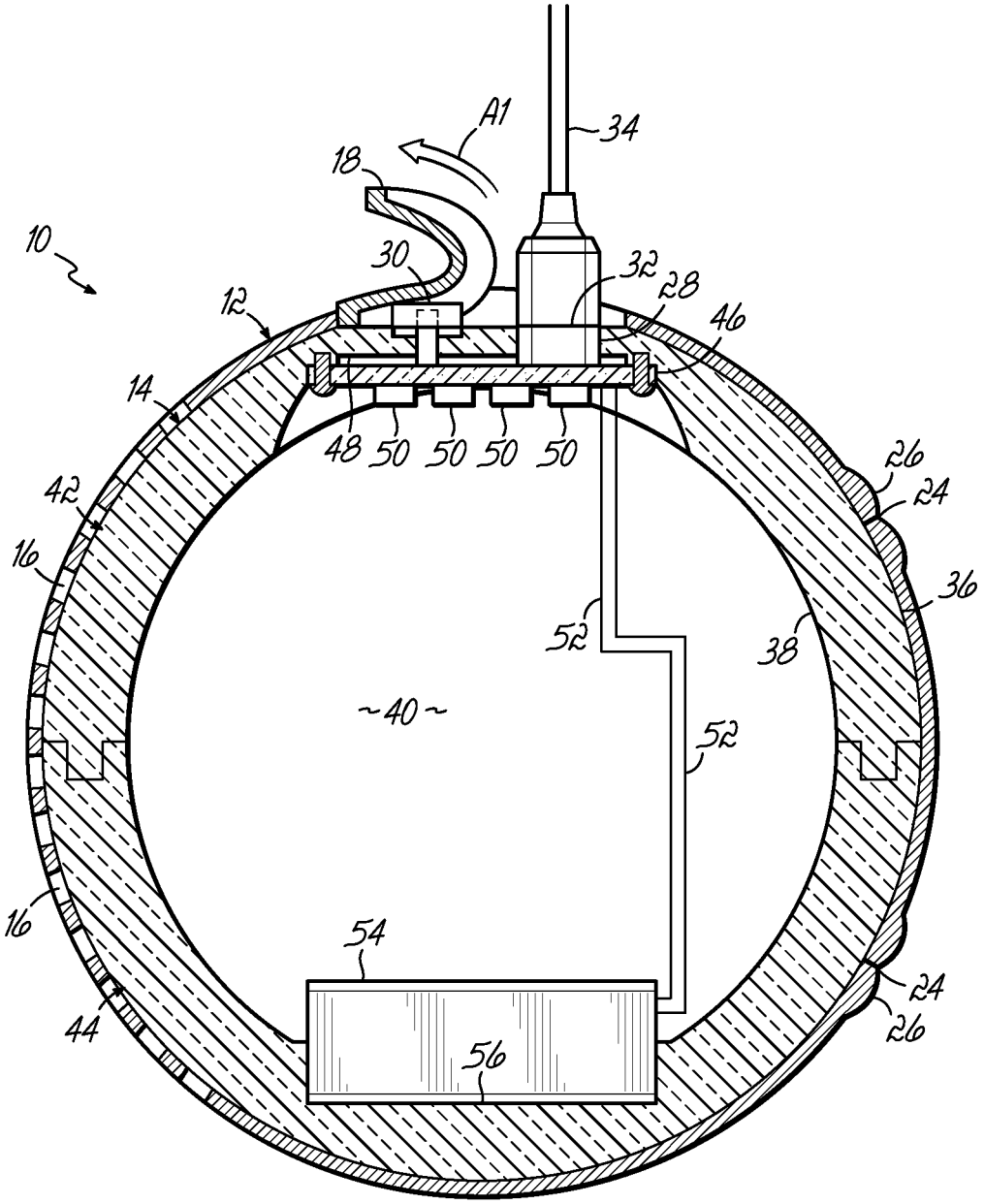
FIG. 4A is cross-sectional view of the lighted sports ball taken along line 4-4 in FIG. 1.

Turning to FIG. 4A, the internals of the lighted sports ball 10 are shown. Beneath the exterior cover 12 is an interior housing 14. The interior housing 14 is constructed of a material through which light can readily pass. For example, the interior housing 14 may be constructed of a translucent plastic or a similar material. The exterior cover 12 is applied to the outer surface 36 of the interior housing 14. It is to be understood that there could be material between the interior housing 14 and the exterior cover 12. For example, an adhesive could be used to further secure the exterior cover 12 to the interior housing 14 or a matting material (e.g., yarn) could be inserted to improve the feel or play of the lighted sports ball 10. The inner surface 38 of the interior housing 14 defines the bounds of the cavity 40 within the interior housing 14. In this embodiment, the interior housing 14 is roughly spherical in shape; however, it is to be understood that the interior housing 14 could take on alternative shapes as appropriate for various sports balls. For example, the interior housing 14 could take on a prolate spheroid shape if the lighted sports ball 10 is a football (as shown, for example, in FIG. 7).

Further, the interior housing 14 may be formed of one or more portions. In the pictured embodiment, the interior housing 14 is formed of two portions—a first half portion 42 and a second half portion 44. The first and second half portions 42, 44 are roughly hemispherical. It is to be understood that the interior housing 14 could be made of more or fewer portions as determined to be appropriate for the particular sports ball. The first and second half portions 42, 44 combine at their peripheries to form the interior housing 14. The first and second half portions 42, 44 may be joined to each other by known means such as adhesives, mechanical fasteners, and/or friction fits.

Still referring to FIG. 4A, the interior housing 14 includes a circuit board 46. The circuit board 46 is mounted (by mechanical fasteners or other means) to the interior housing 14 in the circuit board receiving area 48. Specifically, the circuit board 46 is mounted to the first half portion 42. However, the circuit board 46 could be alternatively arranged within the interior housing 14. The circuit board 46 features at least one light module 50, a controller 30 (e.g., push button), and a charging port 28. The light module 50 emits light that is then transmitted through the interior housing 14 and the apertures 16 in the exterior cover 12. In the depicted embodiment, the circuit board 46 features four light modules 50, but it is to be understood that the circuit board 46 could feature fewer light modules 50 (e.g., one) or many more light modules 50—depending on the characteristics of the particular light module 50 and the desired brightness or characteristics of the lighted sports ball 10. For example, the light modules 50 could be 5050 RGB LEDs capable of emitting colors such as red, blue, green, purple, light blue, and white. It is to be understood that other types of LEDs or lights could be substituted.

The output of the light modules 50 is controlled by the controller 30. In the depicted embodiment, the controller 30 is a push button that extends from the cavity 40, through the interior housing 14, and to the exterior of the lighted sports ball 10 such that the controller 30 can be accessed and interfaced with (e.g., the push button actuated) from the exterior of the lighted sports ball 10. It is to be understood that the controller 30 may take on other forms besides a push button. For example, the controller 30 could include a wireless receiver and allow for a user to control (e.g., address) the light modules 50 from a distance as opposed to having to actuate a physical push button directly on the lighted sports ball 10. Wireless communication could be accomplished through Bluetooth, radio waves, Wi-Fi, or the like. In the depicted embodiment, actuating the push button controller 30 one time turns the light modules 50 on and causes the light modules 50 to emit a pre-selected, default light color. For example, white. Further actuating the push button controller 30 causes the light modules 50 to change color. For example, further actuating the push button controller 30 can cause the light modules 50 to change the color of the emitted light from white to red, blue, green, purple, and light blue. The light emitted by the light modules 50 may be static (e.g., stay a solid color until a new signal is received from the controller 30) or the emitted light may cycle through various colors offered by the light modules 50 (e.g., change in color until the controller 30 communicates the light modules 50 to stop changing color). In this way, the lighted sports ball 10 of the present disclosure offers variety and additional user customization not offered by some known enhanced visibility sports balls.

Still referring to FIG. 4A, the circuit board 46 is connected, by a wire 52, to a battery 54 that powers the light modules 50. The battery 54 is mounted to the interior housing 14 in the battery receiving area 56, located opposite the circuit board 46 and circuit board receiving area 48. Specifically, the battery 54 is mounted to the second half portion 44. However, the battery 54 could be alternatively arranged within the interior housing 14. In the depicted embodiment, the battery 54 is rechargeable. For example, the battery 54 may be a 300 mAh rechargeable battery. However, it is to be understood that the capacity of the battery 54 could be greater or smaller than 300 mAh. The rechargeable battery 54 is more user friendly (especially when combined with wireless charging, described in greater detail below) compared to some known enhanced visibility sports balls which require a user to use and replace a non-rechargeable battery. However, it is to be understood that the battery 54 could be a non-rechargeable battery that is replaceable or not replaceable by a user.

A lighted sports ball 10 with a rechargeable battery 54 can be recharged via the charging port 28 on the circuit board 46. The end 32 of the charging port 28 extends from the cavity 40, through the interior housing 14, and to the exterior of the lighted sports ball 10 such that the charging port 28 can be accessed and interfaced with from the exterior of the lighted sports ball 10. The charging port 28 accepts a charging cable 34 and communicates the power to the battery 54 via a wire 52 that connects the circuit board 46 and the battery 54. The charging port 28 may be a female USB Type-C connector. Alternatively, the charging port 28 could be a female micro-USB Type-B connector. It is to be understood that alternative types of charging port 28 connectors could be substituted. Regardless of the particular type of charging port 28 connector, the charging cable 34 would have a corresponding connector type (e.g., male USB type-C connector, male micro-USB type-B connector, etc.). For example, the charging cable 34 may provide a power input of 5 V and 1-2 A. Further, the battery 54 could be recharged (alternatively or additionally) via wireless charging and thus offer a user flexibility for charging the lighted sports ball 10. For example, the wireless charging could be inductive charging in accordance with the Qi wireless power transfer standard. However, it is to be understood that the rechargeable battery 54 could be wirelessly charged through a different means or standard of wireless power transfer.

Figure 4B:
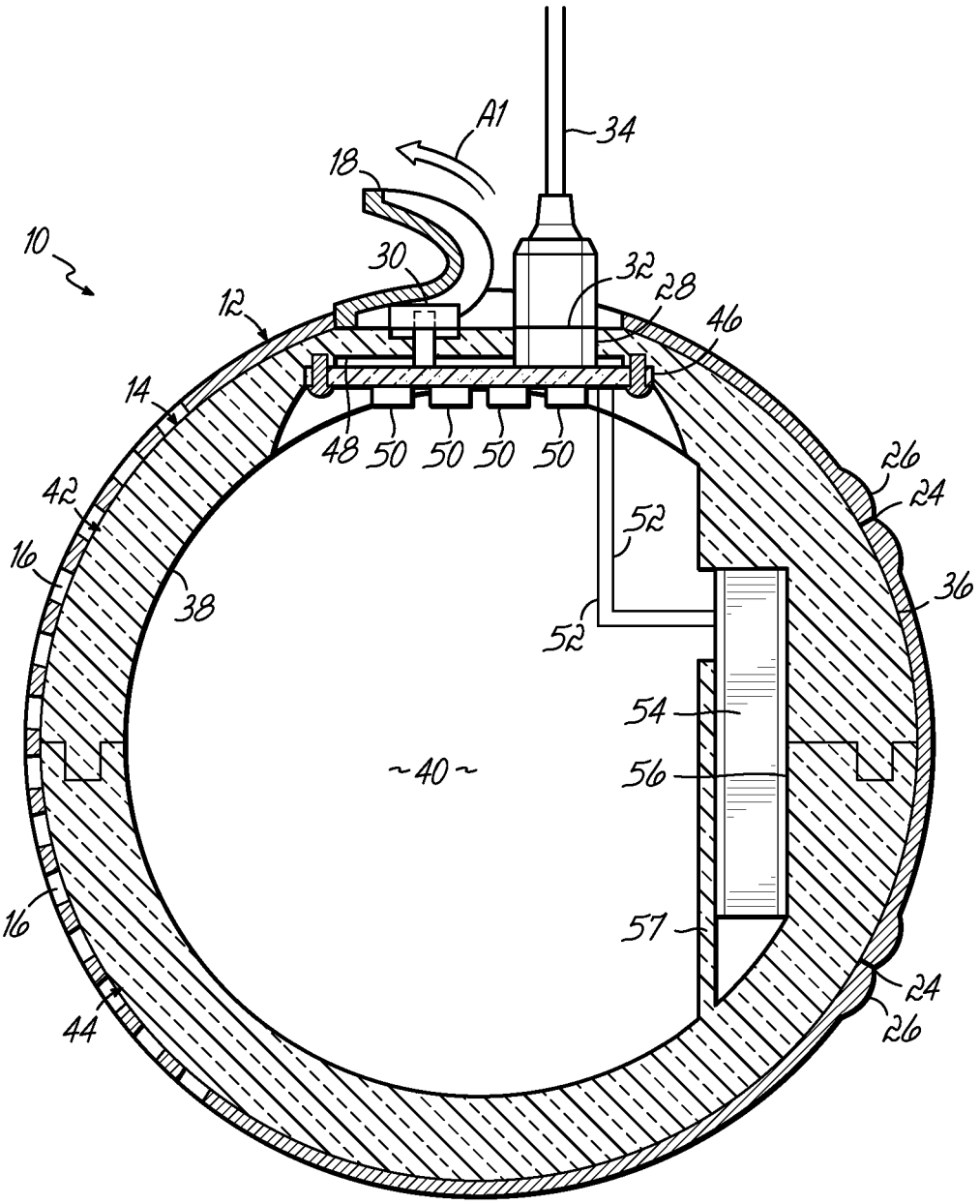
FIG. 4B is a cross-sectional view of an alternative embodiment of the lighted sports ball taken along line 4-4 in FIG. 1.

Referring now to FIG. 4B, the figure shows an alternative embodiment of the internals of the lighted sports ball 10—specifically an alternative arrangement for the battery 54 is shown. In the depicted embodiment, the battery 54 is mounted to the interior housing 14 in the battery receiving area 56. However, the battery 54 and battery receiving area 56 are not located opposite the circuit board 46 and circuit board receiving area 48. Instead, the battery 54 and battery receiving area 56 are located adjacent to the circuit board 46 and circuit board receiving area 48. Further, the battery receiving area 56 includes an extended battery housing 57 that covers a portion of the battery 54 and serves to help prevent the battery 54 from falling out of the battery receiving area 56. In the depicted embodiment, the extended battery housing 57 extends over half of the length of the battery 54 and covers a substantial portion of the battery 54. It is to be understood that the extended battery housing 57 could take on a different form than is pictured in FIG. 4B. For example, the extended battery housing could be longer, shorter, or have a different construction and/or orientation than is depicted in FIG. 4B.

Figure 5:
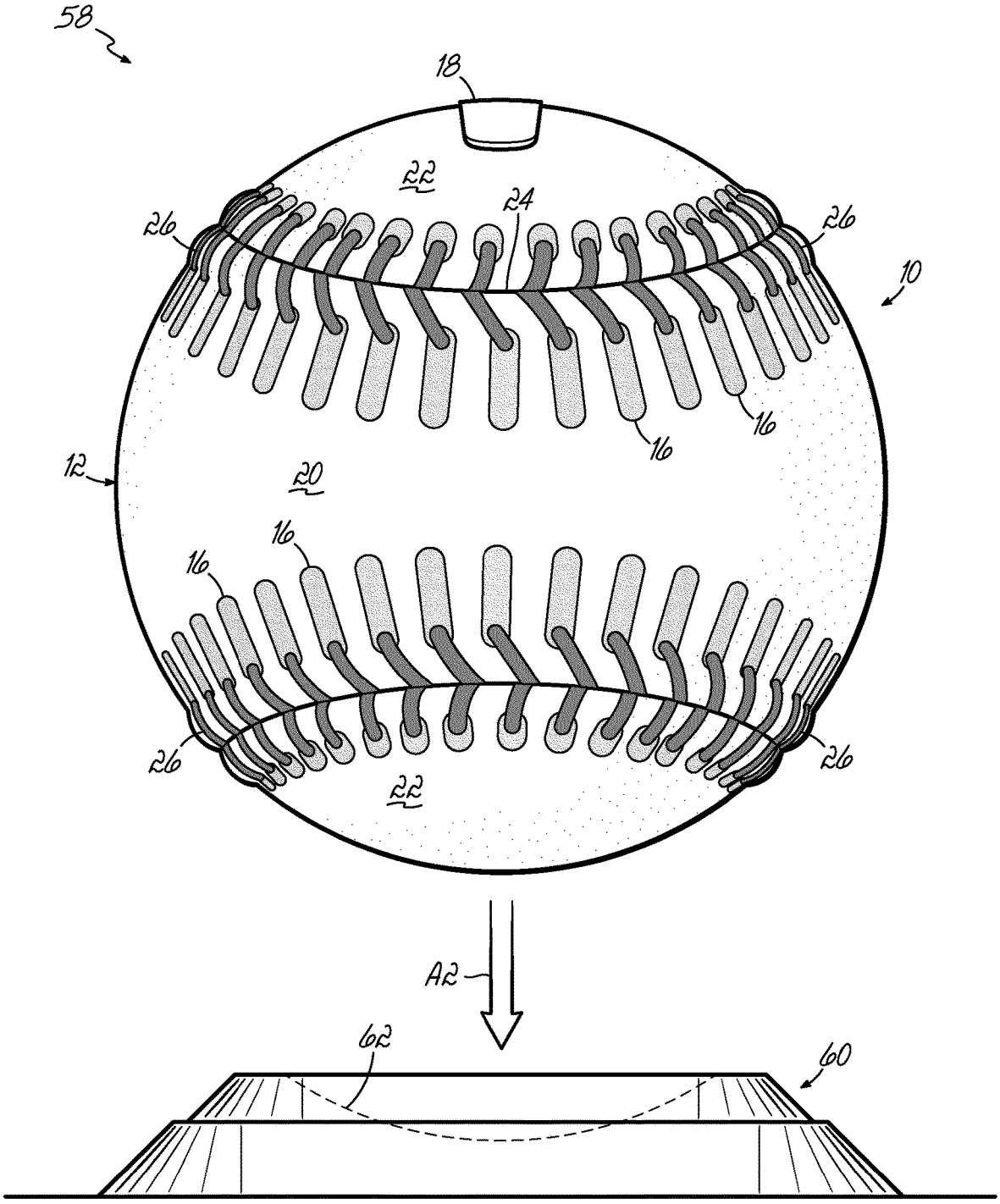
FIG. 5 is a front view of an embodiment of a lighted sports ball kit according to the present disclosure.

Referring now to FIG. 5, the figure shows a lighted sports ball kit 58. The lighted sports ball kit 58 features a lighted sports ball 10 (substantially the same as the lighted sports ball 10 described above in reference to FIGS. 1-4) and a charging stand 60. In this embodiment, the rechargeable battery 54 of the lighted sports ball 10 can be charged wirelessly via the charging stand 60. The wireless charging between the lighted sports ball 10 and the charging stand 60 takes places through inductive charging in accordance with the Qi wireless power transfer standard. It is to be understood that the lighted sports ball 10 could be wirelessly charged through a different means or standard of wireless power transfer.

To wirelessly charge the lighted sports ball 10, a user places the lighted sports ball 10 into the charging stand 60, as indicated by arrow A2. The charging stand 60 features a depression 62 with a complementary shape to that of the lighted sports ball 10 that is configured to receive a portion of the lighted sports ball 10. When seated in the charging stand 60, the lighted sports ball 10 will wirelessly recharge. Further, the charging stand 60 serves to display the lighted sports ball 10 when the lighted sports ball 10 is not in use. Though the embodiment of the light sports ball 10 illustrated in FIG. 5 is enabled for wireless charging, the lighted sports ball 10 still features a charging port 28 that could alternatively be used to charge the rechargeable battery 54 of the lighted sports ball 10 if a user prefers wired charging via the charging cable 34 as opposed to wireless charging via the charging stand 60.

Figure 6:
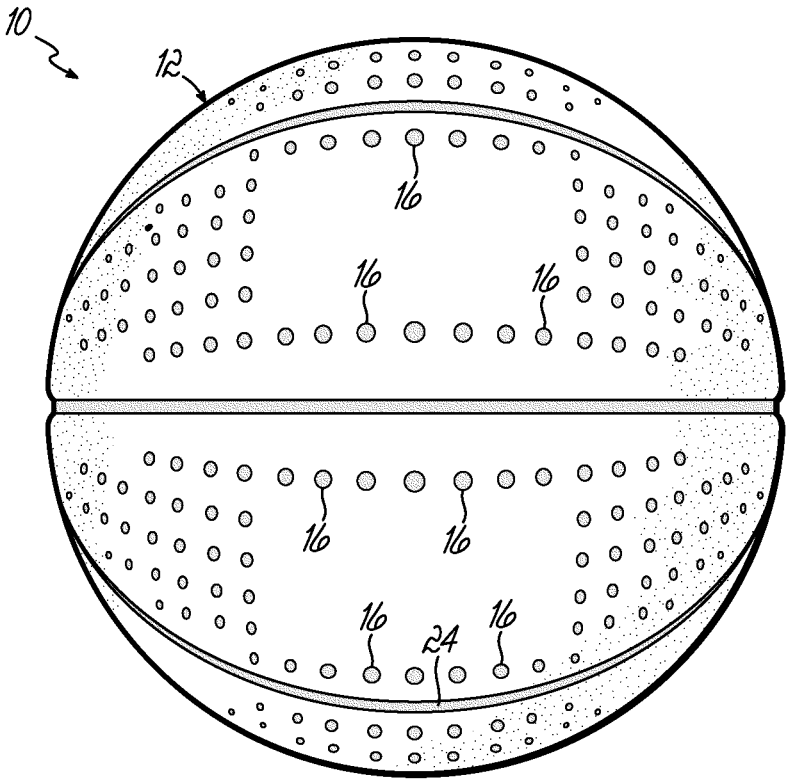
FIG. 6 is a front view of an alternative embodiment of a lighted sports ball according to the present disclosure.
Figure 7:
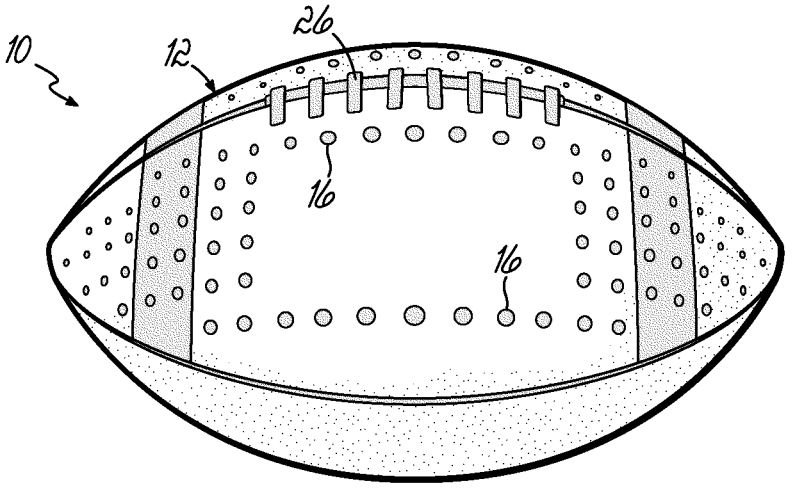
FIG. 7 is a front view of a further alternative embodiment of a lighted sports ball according to the present disclosure.
Figure 8:
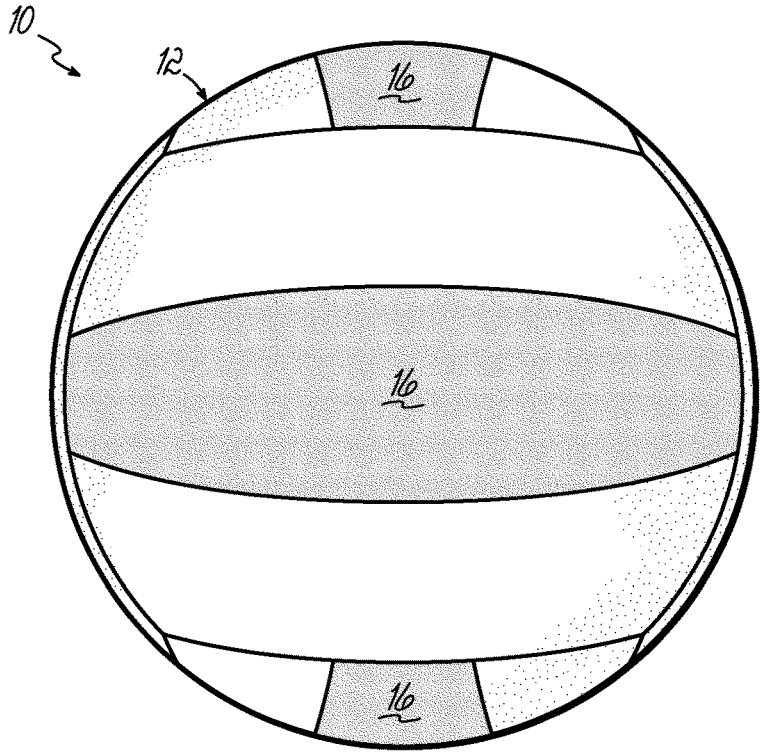
FIG. 8 is a front view of a yet further alternative embodiment of a lighted sports ball according to the present disclosure.
Figure 9:
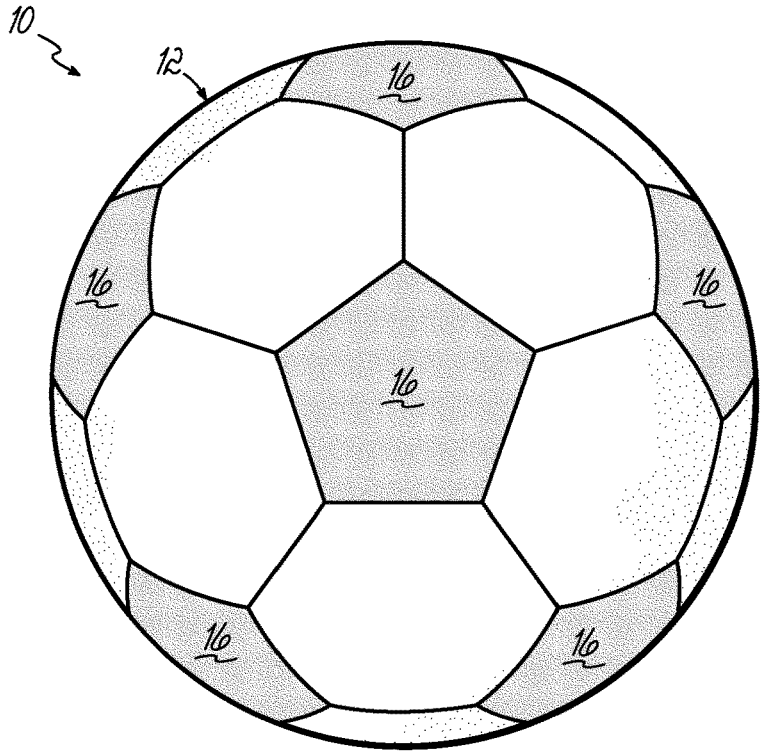
FIG. 9 is a front view of another alternative embodiment of a lighted sports ball according to the present disclosure.

Turning now to FIGS. 6-9, the figures show further alternative embodiments of the lighted sports ball 10. The embodiments of the lighted sports ball 10 shown in FIGS. 1-5 has the appearance of a baseball or softball. However, it is to be understood that the lighted sports ball 10 may take on the appearance of a sports ball other than a baseball or softball. For example, FIG. 6 shows an embodiment of the lighted sports ball 10 where the outer appearance is that of a basketball. Similarly, FIG. 7 shows an embodiment of the lighted sports ball 10 where the outer appearance is that of a football. FIG. 8 shows an embodiment of the lighted sports ball 10 where the outer appearance is that of a volleyball. FIG. 9 shows an embodiment of the lighted sports ball 10 where the outer appearance is that of a soccer ball. FIGS. 6-9 illustrate that the appearance of the lighted sports ball 10 is not limited to that of a baseball. It is to be understood that the lighted sports ball 10 may present an appearance of a basketball, football, volleyball, soccer ball, or any other appropriate sports ball. Further, in alternative embodiments of the lighted sports ball 10, light may be emitted from other portions of the sports ball in addition to the apertures 16. For example, in the lighted sports ball 10 of FIG. 6 (e.g., basketball embodiment) light may be emitted from the seam 24 of the sports ball. Similarly, in the lighted sports ball 10 of FIG. 7 (e.g., football embodiment) light may be emitted from the threads 26 of the sports ball, for example.

While the present invention has been illustrated by the description of various embodiments and while these embodiments have been described in some detail, it is not the intention of the Applicant to restrict or in any way limit the scope of the invention to such detail. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A lighted sports ball, comprising:

an interior housing through which light can pass, the interior housing having an outer surface and an inner surface, the inner surface defining a bound of a cavity within the interior housing;

a circuit board mounted to the inner surface of the interior housing and connected to a battery, the circuit board having at least one light module and a controller for controlling an output of the at least one light module; and an exterior cover applied over the outer surface of the interior housing, the exterior cover having at least one aperture through which light from the at least one light module can pass, wherein the controller is a push button operatively connected to the circuit board, the push button extending through the interior housing such that the push button can be actuated from an exterior of the lighted sports ball, wherein a charging port is operatively connected to the circuit board, an end of the charging port accessible from an exterior of the lighted sports ball, wherein an end of the push button that extends through the interior housing and the end of the charging port are covered by a protective cap, wherein the end of the push button and the end of the charging port are covered by the same protective cap.

2. The lighted sports ball of claim 1, the interior housing further comprising a first half portion and a second half portion, the first half portion and the second half portion combining at their respective peripheries to form the interior housing.

3. The lighted sports ball of claim 2, wherein the circuit board is mounted in a circuit board receiving area of the first half portion, wherein the battery is mounted in a battery receiving area of the second half portion, and wherein at least one wire connects the circuit board and the battery.

4. The lighted sports ball of claim 2, wherein the circuit board is mounted in a circuit board receiving area of the first half portion, wherein the battery is mounted in a battery receiving area, the battery receiving area including an extended battery housing extending from the interior housing to cover a substantial portion of the battery, and wherein at least one wire connects the circuit board and the battery.

5. The lighted sports ball of claim 1, wherein the end of the push button abuts the protective cap when the protective cap is depressed.

6. The lighted sports ball of claim 1, wherein actuating the push button causes the at least one light module to emit the light and wherein further actuating the push button changes the color of the light emitted by the at least one light module.

7. The lighted sports ball of claim 1, wherein the controller can be addressed wirelessly to cause the at least one light module to emit the light and to change the color of the emitted light.

8. The lighted sports ball of claim 1, wherein the battery is rechargeable.

9. The lighted sports ball of claim 8, wherein the battery can be recharged wirelessly.

10. The lighted sports ball of claim 8, wherein the charging port is usable to charge the rechargeable battery.

11. The lighted sports ball of claim 1, wherein a portion of the protective cap is moveable to allow access to the charging port.

12. The lighted sports ball of claim 1, the exterior cover further comprising a first cover portion and a second cover portion, wherein the first cover portion and the second cover portion are stitched together at a seam with a thread and combine to cover the interior housing.

13. The lighted sports ball of claim 1, wherein the sports ball may be selected from the group consisting of a baseball, basketball, football, volleyball, and soccer ball.

14. A lighted sports ball kit, the kit comprising:

a lighted sports ball, comprising:

an interior housing through which light can pass, the interior housing having an outer surface and an inner surface, the inner surface defining a bound of a cavity within the interior housing;

a circuit board mounted to the inner surface of the interior housing and connected to a rechargeable battery, the circuit board having at least one light module and a controller for controlling an output of the at least one light module; and an exterior cover applied over the outer surface of the interior housing, the exterior cover having at least one aperture through which a light from the at least one light module can pass, wherein the controller is a push button operatively connected to the circuit board, the push button extending through the interior housing such that the push button can be actuated from an exterior of the lighted sports ball, wherein a charging port is operatively connected to the circuit board, an end of the charging port accessible from an exterior of the lighted sports ball, wherein an end of the push button that extends through the interior housing and the end of the charging port are covered by a protective cap, wherein the end of the push button and the end of the charging port are covered by the same protective cap; and a charging stand configured to receive the lighted sports ball thereupon and charge the rechargeable battery.

15. The lighted sports ball kit of claim 14, wherein the battery can be recharged wirelessly, and wherein the charging stand is configured to wirelessly recharge the rechargeable battery.

16. The lighted sports ball kit of claim 14, wherein actuating the push button causes the at least one light module to emit the light and wherein further actuating the push button changes the color of the light emitted by the at least one light module.

17. A method of using a lighted sports ball, the method comprising:

providing a lighted sports ball, the lighted sports ball comprising:

an interior housing through which light can pass, the interior housing having an outer surface and an inner surface, the inner surface defining a bound of a cavity within the interior housing;

a circuit board mounted to the inner surface of the interior housing and connected to a rechargeable battery, the circuit board having at least one light module and a push button for controlling an output of the at least one light module; and an exterior cover applied over the outer surface of the interior housing, the exterior cover having at least one aperture through which a light from the at least one light module can pass, wherein the push button extends through the interior housing such that the push button can be actuated from an exterior of the lighted sports ball, wherein a charging port is operatively connected to the circuit board, an end of the charging port accessible from an exterior of the lighted sports ball, wherein an end of the push button that extends through the interior housing and the end of the charging port are covered by a protective cap, wherein the end of the push button and the end of the charging port are covered by the same protective cap;

actuating the push button to cause the at least one light module to emit the light; and further actuating the push button to change the color of the light emitted by the at least one light module.

18. The method of using a lighted sports ball of claim 17, wherein the method of using the lighted sports ball further comprises charging the rechargeable battery by plugging a charging cable into the charging port to provide power to the rechargeable battery.

19. The method of using a lighted sports ball of claim 17, the method of using the lighted sports ball further comprising charging the rechargeable battery by placing the lighted sports ball on a charging stand and wirelessly providing power to the rechargeable battery.

* * * * *